US009499993B1

(12) United States Patent
Kugler et al.

(10) Patent No.: US 9,499,993 B1
(45) Date of Patent: Nov. 22, 2016

(54) DECK PEDESTAL

(71) Applicant: United Construction Products, Inc., Denver, CO (US)

(72) Inventors: William E. Kugler, Denver, CO (US); Stephen J. Knight, III, Littleton, CO (US)

(73) Assignee: United Construction Products, Inc., Denver, CO (US)

( * ) Notice: Subject to any disclaimer, the term of this patent is extended or adjusted under 35 U.S.C. 154(b) by 0 days.

(21) Appl. No.: 14/725,488

(22) Filed: May 29, 2015

(51) Int. Cl.
*E04F 15/024* (2006.01)

(52) U.S. Cl.
CPC ..... *E04F 15/0247* (2013.01); *E04F 15/02464* (2013.01); *E04F 15/02476* (2013.01)

(58) Field of Classification Search
CPC ..... E04F 15/0247; E04F 15/02476; E04F 15/02464
USPC ..... 52/126.6, 263; 254/100
See application file for complete search history.

(56) References Cited

U.S. PATENT DOCUMENTS 3,084,911 A * 4/1963 Spiselman ..... F16B 39/28 248/354.4
3,318,057 A * 5/1967 Norsworthy ..... E04F 15/02452 52/126.6
3,681,882 A * 8/1972 Bettinger ..... E04F 15/0247 52/126.6
4,258,516 A 3/1981 Mori et al.
4,558,544 A * 12/1985 Albrecht ..... E04F 15/02452 52/126.1
5,501,754 A * 3/1996 Hiraguri ..... E04F 15/024 156/71
6,363,685 B1 * 4/2002 Kugler ..... E04F 15/02183 52/126.6
7,096,637 B2 8/2006 McMillan
2002/0144477 A1 10/2002 Chen
2009/0145057 A1 6/2009 Tsukada et al.
2010/0281790 A1 11/2010 Burgess

FOREIGN PATENT DOCUMENTS

JP 2000170356 A * 6/2000 ..... E04F 15/00
JP 4124890 B2 5/2008

OTHER PUBLICATIONS

JP2000170356_Machine_translate; Machine translate of JP2000170356, Osaka, Jun. 20, 2000 (retrived from EPO website).*

* cited by examiner

*Primary Examiner* — Babajide Demuren
(74) *Attorney, Agent, or Firm* — Marsh Fischmann & Breyfogle LLP; Jonathon A. Szumny

(57) ABSTRACT

A support pedestal for adjustably supporting a building surface component above a fixed surface and including a base member having a base plate that is configured to be placed upon a surface, a support member having a support plate that is configured to support at least one building surface component, and an adjustment apparatus interconnecting the base member and the support member that facilitates adjustment of each of the base member and support member relative to the other of the base member and the support member in numerous manners. The adjustment apparatus includes a first connector receivable in a first receiver attached to and extending away from one of the base plate or support plate, a second connector attachable to the other of the base plate or support plate, and a shaft threadably interconnecting the base and support connectors.

27 Claims, 9 Drawing Sheets

DECK PEDESTAL

BACKGROUND OF THE INVENTION

1. Field of the Invention

This invention relates to the field of structural systems for elevating surface materials such as for elevated floors, decks and walkways.

2. Description of Related Art

Elevated building surfaces such as elevated floors, decks, terraces and walkways are desirable in many interior and exterior environments. One common system for creating such surfaces includes a plurality of surface tiles, such as concrete tiles (pavers), stone tiles, clay tiles, ceramic tiles, or wood tiles, and a plurality of spaced-apart support pedestals and/or joists or stringers upon which the tiles are placed to be supported above a fixed surface. For example, in outdoor applications, the surface may be elevated above a fixed surface to promote drainage, to provide a level structural surface for walking, and/or to prevent deterioration of or damage to the surface tiles.

Although a variety of shapes are possible, in many applications the surface tiles are rectangular in shape, having four corners. In the case of a rectangular shaped tile, each of the spaced-apart support pedestals can therefore support four adjacent surface tiles at the tile corners. Stated another way, each rectangular surface tile can be supported by four pedestals that are disposed under each of the corners of the tile. Large or heavy tiles can be supported by additional pedestals at positions other than at the corners of the tiles.

The pedestals can have a fixed height or can have an adjustable height such as to accommodate variations in the contour of the fixed surface upon which the pedestals are placed or to create desirable architectural features. Various types of support pedestals are disclosed in U.S. Pat. No. 6,363,685 to Kugler, U.S. Patent Publication No. 2004/0261329 to Kugler et al., U.S. Pat. No. 8,122,612 to Knight, III et al., and U.S. Pat. No. 8,898,999 to Kugler et al., each of which is incorporated herein by reference in its entirety. For instance, many types of support pedestals include a threaded base member and a threaded support member that is threadably engaged with the base member to enable the height of the support pedestal to be adjusted by rotating the support member or the base member relative to the other. Support pedestals can also include an extender member (e.g., a coupling or coupler member) disposed between the base member and the support member for further increasing the height of the pedestal, if necessary.

SUMMARY OF THE INVENTION

In one aspect, a support pedestal for adjustably supporting a building surface component above a fixed surface is disclosed. The support pedestal includes a base member including a base plate that is configured to be placed upon a surface, a support member including a support plate that is configured to support at least one building surface component, and an adjustment apparatus interconnecting the base member and the support member that facilitates adjustment of each of the base member and support member relative to the other of the base member and the support member.

The disclosed adjustment apparatus includes a first connector having opposite first and second portions and a first connector axis extending through the first and second portions, a second connector having opposite first and second portions and a second connector axis extending through the first and second portions, and a shaft having opposite first and second portions and a shaft axis extending through the first and second portions. The first portion of the first connector is receivable in a first receiver attached to and extending away from one of the base plate or support plate and rotatable about the first connector axis when the first portion is received in the first receiver. The first portion of the second connector is attachable to the other of the base plate or support plate.

The second portions of the first and second connectors respectively include first and second connector threads that are configured to threadably engage with respective first and second threads of a shaft. The shaft includes opposite first and second portions and a shaft axis extending through the first and second portions, wherein the first portion includes the first shaft threads and the second portion includes the second shaft threads. The base connector axis, support connector axis and shaft axis are collinear to a central axis through the support pedestal. Rotation of the first connector about the first connector axis adjusts (e.g., increases or decreases) a distance between the base plate and the support plate along the central axis and rotation of the shaft about the shaft axis adjusts a distance between the base plate and the support plate along the central axis.

In one arrangement, the first portion of the second connector may be rigidly attached to (and non-rotatable relative to) the other of the base and support plate. For instance, the first receiver (into which the first connector is rotatably receivable) may be attached (e.g., rigidly) to the base plate and the second connector may be rigidly attached to the support plate, or vice versa. In another arrangement, the first portion of the second connector is receivable in a second receiver attached to (e.g., rigidly) and extending away from the other of the base plate or support plate and rotatable about the second connector axis when the first portion is received in the second receiver, where rotation of the second connector about the second connector axis adjusts a distance between the base plate and the support plate along the central axis.

In one embodiment, the second portion of the first connector includes inner and outer walls, where the first connector threads are disposed on the inner wall, where the first shaft threads are disposed on an outer wall on the first portion of the shaft, and wherein the first portion of the shaft is threadably receivable through the second portion of the first connector when the first portion of the first connector is received in the first receiver. In another embodiment, the second portion of the second connector includes inner and outer walls, where the second connector threads are disposed on the inner wall, where the second shaft threads are disposed on an outer wall on the second portion of the shaft, and where the second portion of the shaft is threadably receivable through the second portion of the second connector when the first portion of the second connector is received in the second receiver.

In another arrangement disclosed herein, a method includes providing the support pedestal disclosed herein; inhibiting rotation of the shaft about the shaft axis; and rotating, during the inhibiting, the first connector about the first connector axis to thread the first connector threads along the first shaft threads and adjust the distance between the support plate and the base plate along the central axis. In another arrangement disclosed herein, a method includes inhibiting rotation of the shaft about the shaft axis; and rotating, during the inhibiting, the first connector about the first connector axis to thread the first connector threads along the first shaft threads and adjust the distance between the support plate and the base plate along the central axis. In a further arrangement disclosed herein, a method includes first inhibiting rotation of the second connector and the other of the base plate or support plate; second inhibiting rotation of the first connector and the one of the base plate or support plate; and rotating, during the first and second inhibiting, the shaft about the shaft axis to simultaneously respectively thread the first and second shaft threads along the connector threads and adjust the distance between the support plate and the base plate along the central axis.

In another aspect disclosed herein a method of fabricating a plate for a support pedestal used to support a building surface component above a fixed surface includes forming one or more ribs into a sheet of material adjacent a periphery of the sheet so that the rib extends substantially continuously about a central axis of the sheet that is perpendicular to first and second opposite surfaces of the sheet and punching a series of spacer tabs out of the sheet between the central axis and the rib that are configured to space adjacent building surface components placed over the sheet.

In addition to the exemplary aspects and embodiments described above, further aspects and embodiments will become apparent by reference to the drawings and by study of the following descriptions.

DESCRIPTION OF THE INVENTION

Figure 1:
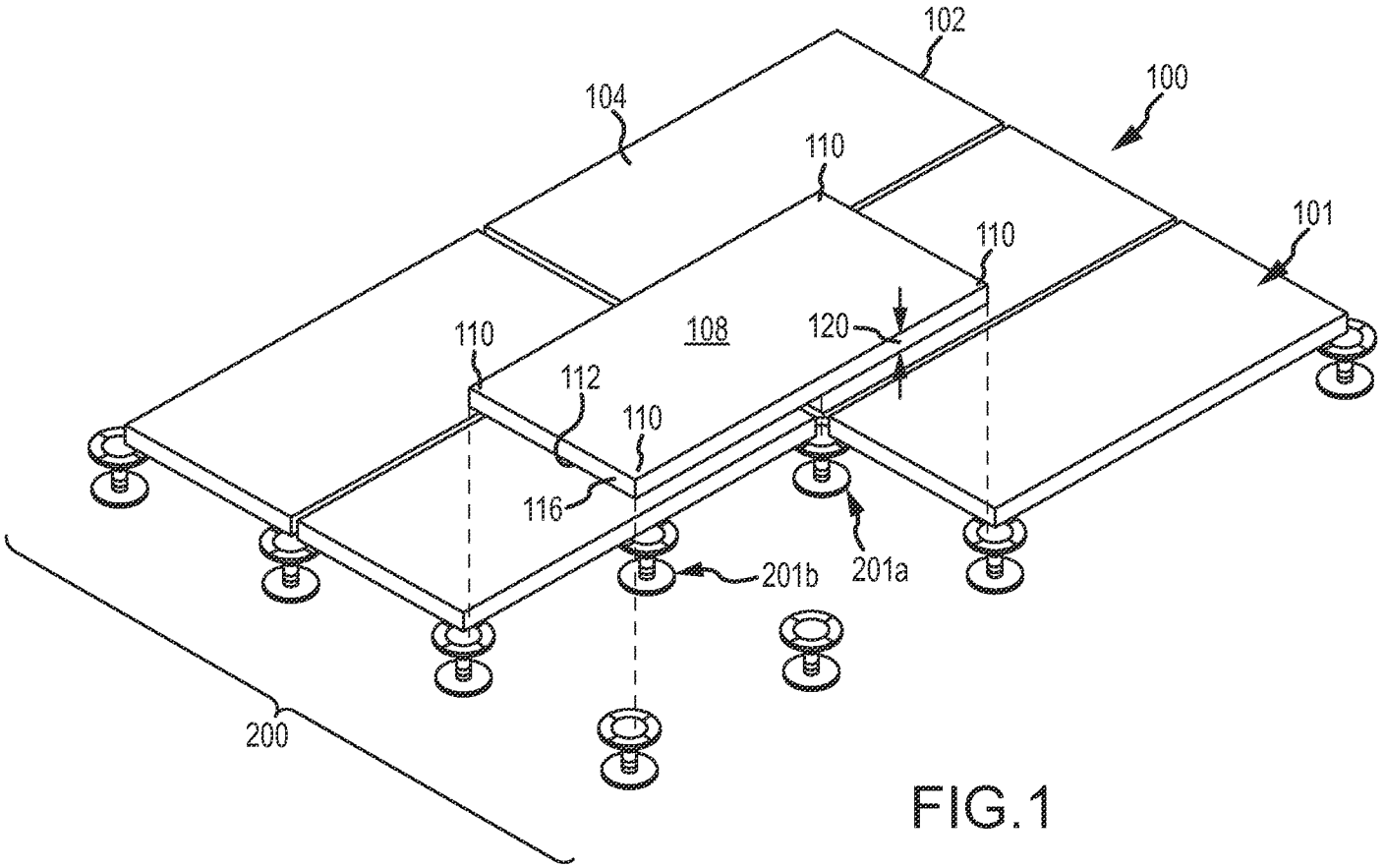
FIG. 1 is a perspective view of an interior or exterior building surface assembly.
Figure 2:
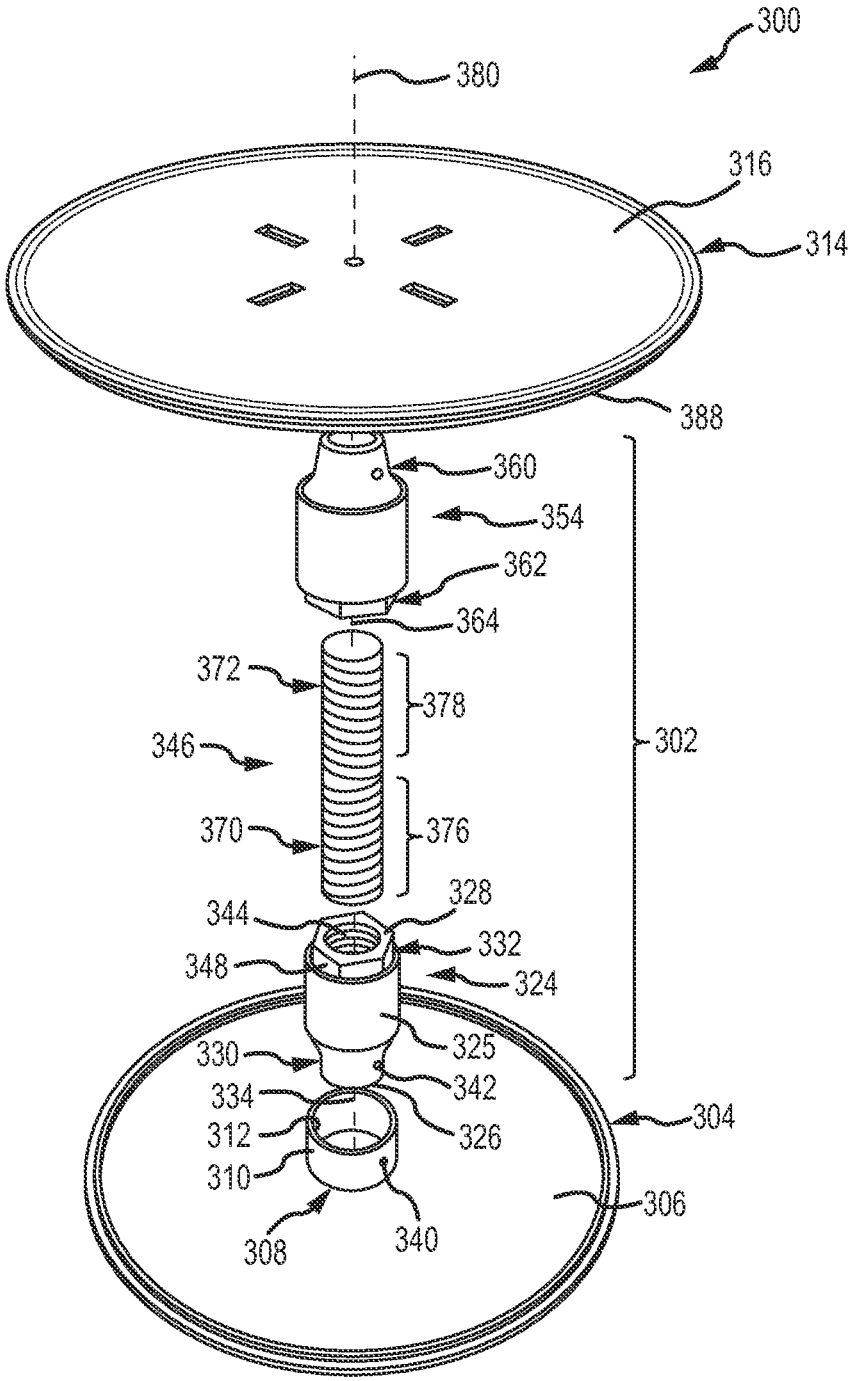
FIG. 2 is an exploded perspective view of a support pedestal for use with the assembly of FIG. 1.
Figure 3:
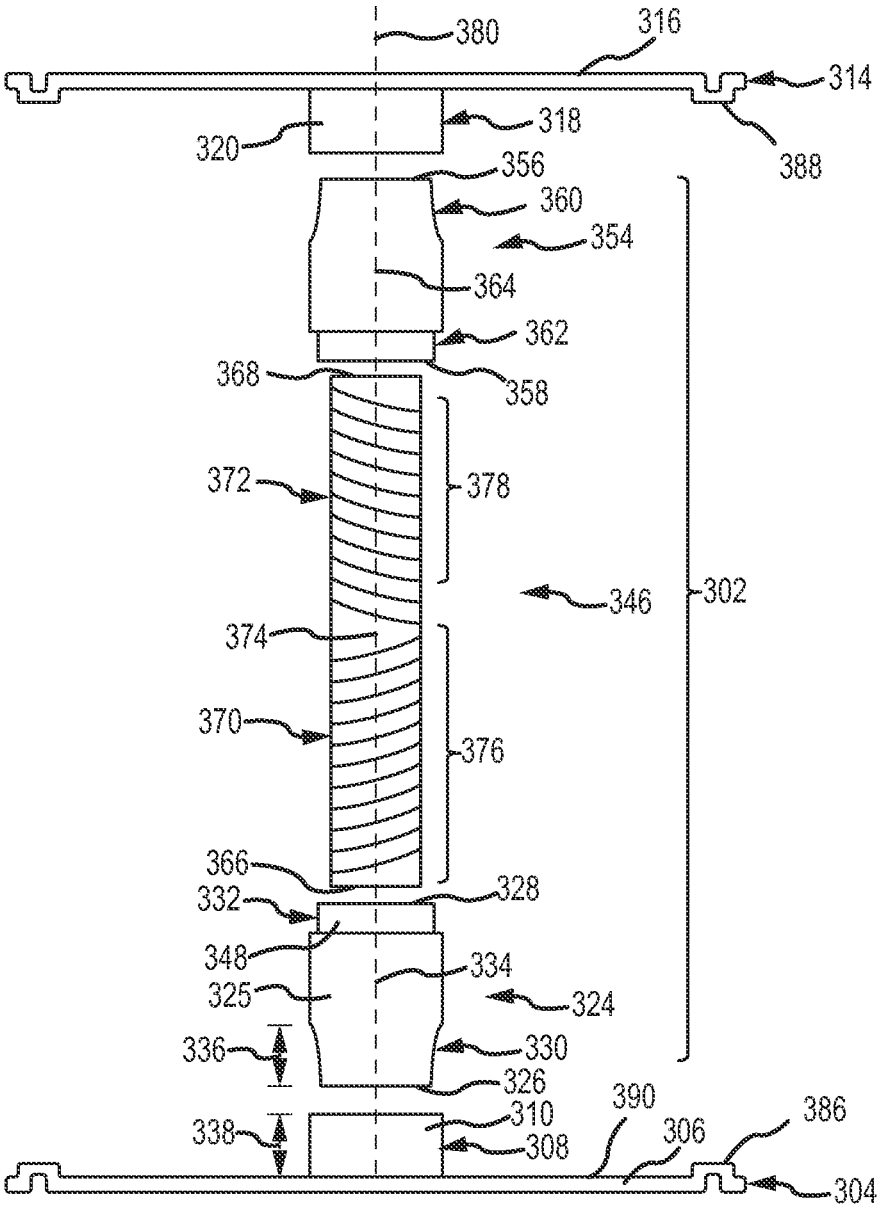
FIG. 3 is an exploded side view of the support pedestal of FIG. 2.
Figure 4:
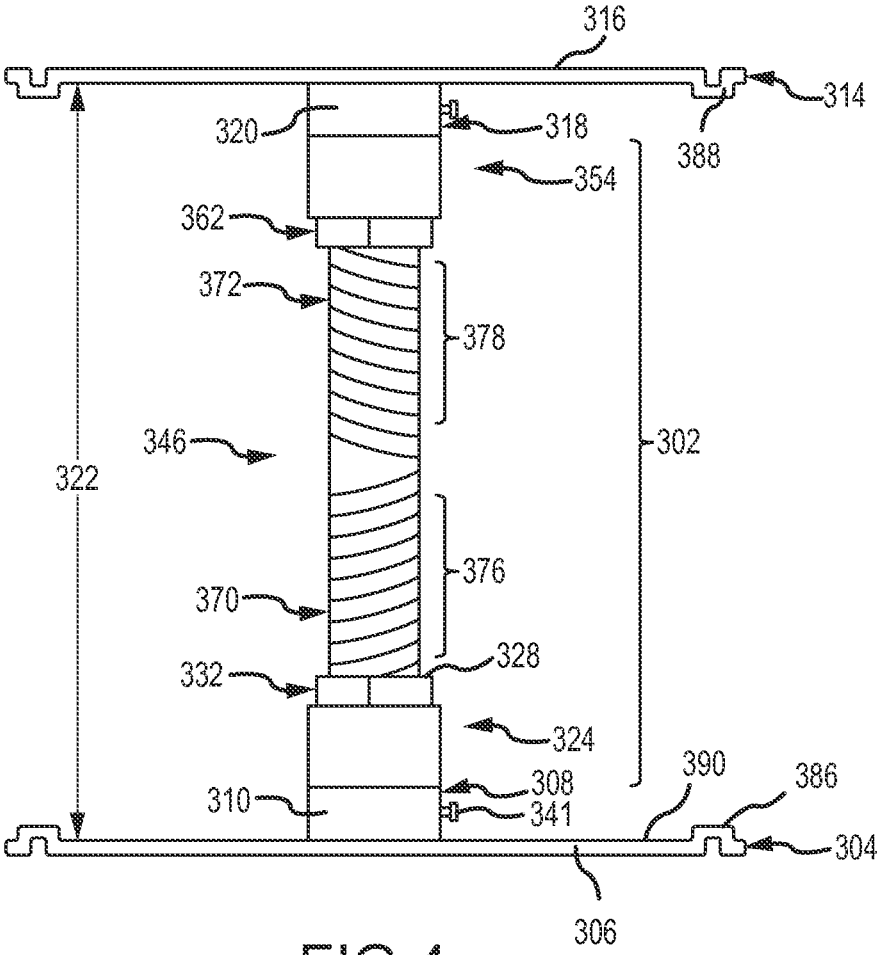
FIG. 4 is an assembled side view of the support pedestal of FIG. 2.
Figure 5:
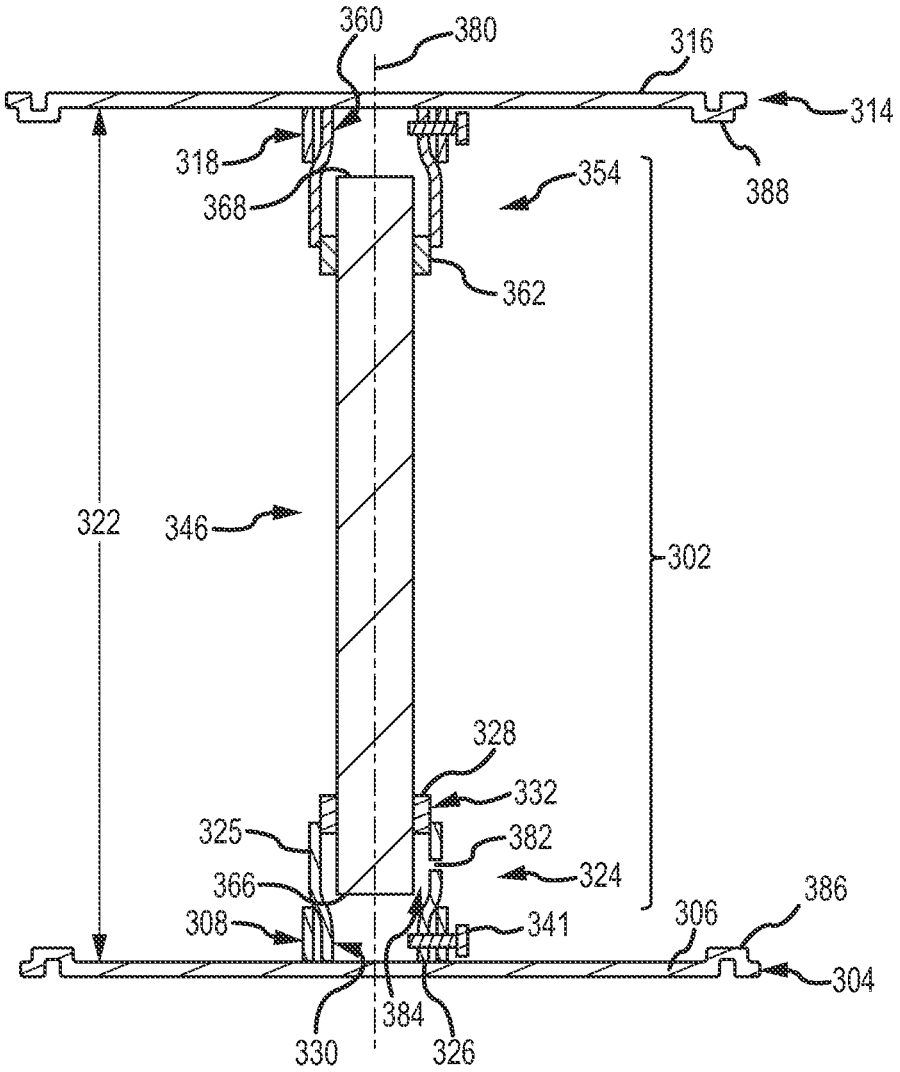
FIG. 5 is a cross-section of the view of FIG. 4.

FIG. 1 illustrates a portion of an elevated building surface assembly 100 that includes a building surface 101 formed from a plurality of building surface components 102 (e.g., surface tiles, pavers, flooring units, etc.). The building surface components 102 are elevated above a fixed surface by a support structure 200 that includes a plurality of spaced-apart support members such as support pedestals 201. Each building surface component 102 may broadly include opposing top and bottom surfaces 108, 112, one or more corner portions 110, one or more outer edge segments 120 disposed between adjacent corner portions 110, and a thickness 120 between the top and bottom surfaces 108, 112. The building surface components 102 may take various shapes (e.g., rectangular as shown, square, hexagonal, and/or other shapes) and may be made from virtually any material from which a building surface is to be constructed. Examples include, but are not limited to, slate tiles, natural stone tiles, composite tiles, concrete tiles (e.g., pavers), wooden deck tiles, tiles of metal or fiberglass grating, porcelain, ceramic, plastic, composites, and the like.

The support pedestals 201 can be placed in a spaced-apart relation on fixed surfaces including, but not limited to, rooftops, plazas, over concrete slabs including cracked or uneven concrete slabs or sub-floors and can be placed within fountains and water features and the like. The elevated building surface assembly 100 can be used for both interior and exterior applications. For instance, each of the building surface components 102 may be placed upon several support pedestals 201 to elevate the building surface component 102 above the fixed surface. As illustrated in FIG. 1, some support pedestals 201*a* may be disposed beneath four corner portions 110 of adjacent building surface components 102. Other support pedestals 201*b* may be disposed under the outer edge segments 116 of the building surface components 102. That is, the support pedestals 201*b* may be placed between the corner portions 110 and proximate to a central portion of the outer edge segment 116. Such a configuration may be desirable when using very heavy and/or very large building surface components, such as large concrete building surface components, when placing heavy objects on the elevated building surface, or the like. Although not illustrated, support pedestals 201 may be disposed in other locations, such as below a central portion of the building surface components 102.

The support pedestals 201 forming the support structure 200 may be height-adjustable, fixed height, or any combination thereof and may be constructed of any appropriate materials (e.g., metals, plastics, carbon fibers, composites, etc.). Broadly, each support pedestal 201 may include a lower portion that is adapted to be placed upon a fixed surface, an upper portion for receiving a building surface component 102, and a central section extending between or otherwise interconnecting (e.g., perpendicularly) the upper and lower portions. The support pedestals 201 may be laid out in various configurations as may be dictated by the shape and size of the building surface components, such as a rectangular configuration or a triangular configuration to support rectangular or triangular building surface components.

Turning now to FIGS. 2-5, a support pedestal 300 (e.g., one or more of support pedestals 201 of FIG. 1) for supporting building surface components (e.g., building surface components 101 of FIG. 1) of an elevated building surface assembly (e.g., elevated building surface assembly 100 of FIG. 1) according to one embodiment is shown. As will be discussed in more detail in the discussion that follows, the support pedestal 300 includes an adjustment apparatus 302 that may be manipulated in numerous manners to effect varying levels and degrees of axial adjustment of the support pedestal 300 (e.g., vertical adjustment). In one arrangement, the adjustment apparatus 302 may also allow for tilting of one or more components of the support pedestal 300 to accommodate leveling of the building surface components being supported by the support pedestal 300.

Broadly, the support pedestal 300 may include a lower portion such as a base member 304 including a base plate 306 and a first or base receiver 308 connected to the base plate 306 in any appropriate manner and extending away from the base plate 306. The base receiver 308 may include a generally cylindrical wall 310 and an opening 312 inside the cylindrical wall 310 for receiving a first portion of the adjustment apparatus 302 via an end of the cylindrical wall 310 opposite the base plate 306 as discussed below. The support pedestal 300 may also include an upper portion such as a support member 314 including a support plate 316 and a second or support receiver 318 connected to the support plate 316 in any appropriate manner and extending away from the support plate 316. Like the base receiver 308, the support receiver 318 may include a generally cylindrical wall 320 and an opening (not shown) inside the cylindrical wall 320 for receiving an opposite second portion of the adjustment apparatus 302 via an end of the cylindrical wall 320 opposite the support plate 316 as discussed below.

With continued reference to FIGS. 2-5, the support pedestal 300 also includes a central section in the form of the adjustment apparatus 302 that interconnects the base member 304 to the support member 314 and allows for adjustment of the base member 304 relative to the support member 314 and/or vice versa. Stated differently, the adjustment apparatus 302 allows an operator to adjust a distance 322 (e.g., vertical distance, see FIG. 4) between the base plate 306 and the support plate 316 either before or after one or more building surface components have been loaded on top of the support plate 316 (on a surface of the support plate 316 opposite that from which the support receiver 318 extends). Broadly, the adjustment apparatus 302 includes first and second connectors that are respectively attachable to and/or matable with the base and support members 304, 314 (or vice versa) and a shaft 346 that threadably engages with the first and second connectors to facilitate adjustment between the base and support plates 306, 316.

As an example, the first connector may be in the form of a base connector 324 having opposite first and second free ends 326, 328 respectively disposed on opposite first and second sections or portions 330, 332 of the base connector 324 and a first or base connector axis 334 extending through the first and second free ends 326, 328 and first and second portions 330, 332. For instance, the first portion 330 may be receivable in the opening 312 of the base receiver 308 in a direction along the base connector axis 334 and rotatable about the base connector axis 334 when received or disposed in the base receiver 308. That is, the first and second portions 330, 332 of the base connector 324 may be simultaneously rotatable about the base connector axis 334 when the first portion 330 is seated in the base receiver 308. In one arrangement, the first portion 330 may be in the form of a generally cylindrical member having an outer diameter that is just less than an inner diameter of the cylindrical wall 310 of the base receiver 308 (e.g., to limit tilting of the first portion 330 relative to the base receiver 308) so that the first portion 330 may be inserted into the base receiver 308 and rotated about the base connector axis 334.

In another arrangement, the first portion 330 may be in the form of a substantially frustoconical member whose outer diameter generally decreases in a direction towards the first free end 326. For instance, and as shown in FIGS. 2, 3, 5 and 6*a*, the first portion 330 may be in the form of a "swaged" frustoconical member whose outer diameter decreases in a direction towards the first free end 326, albeit at a slowing rate of outer diameter decrease. Constructing the first portion 330 as a frustoconical member advantageously facilitates insertion of the first portion 330 into the base receiver 308 by allowing the first portion 330 to enter the base receiver 308 at angles other than perpendicular to the base plate 306 (i.e., other than perpendicular angles between the base connector axis 334 and the top of the base plate 306). Furthermore, this arrangement allows the base connector 324 (e.g., the base connector axis 334) to tilt relative to the base plate 306 while the first portion 330 is seated in the base receiver 308 to accommodate leveling of the support plate 316. In other words, the frustoconical or otherwise tapered nature of the first portion 330 of the base connector 324 creates a joint between the base member 304 and the adjustment apparatus 302 that allows the adjustment apparatus 302 and support member 314 to tilt relative to the base member 304 and thus the base and support plates 306, 316 to assume non-parallel positions relative to each other (e.g., allows respective planes within which the base and support plates 306, 316 are disposed to assume non-parallel positions). In this arrangement, a height 336 of the first portion 330 of the base connector 324 may be less than a height 338 of the cylindrical wall 310 of the base receiver 308 to allow for such tilting.

In another arrangement, a height 336 of the first portion 330 of the base connector 324 may be substantially equal to a height 338 of the cylindrical wall 310 of the base receiver 308. See FIG. 3. This arrangement allows the first free end 326 of the base connector 324 to contact a bottom of the base receiver 308 (e.g., a top surface of the base plate 306) when the first portion 330 is seated in the base receiver 308 (e.g., to limit compressive stress of the cylindrical wall 310 of the base receiver 308 by a load disposed on the support plate 316) while substantially concealing the first portion 330 within the base receiver 308.

The base connector 324 may be selectively non-rotatable about the base connector axis 334 when seated in the base receiver 308 for reasons discussed below. Stated differently, a user may be able to selectively inhibit rotation of the base connector 324 about the base connector axis 334 in various manners when the first portion 330 is first seated in the base receiver 308. In one arrangement, the base receiver 308 may include at least one aperture 340 through the cylindrical wall 310 through which a fastener 341 (e.g., screw, bolt, see FIGS. 4-5) may be threaded into forcible contact with the first portion 330 of the base connector 324 to inhibit rotation thereof about the base connector axis 334. In one variation, the first portion 330 may include an aperture 342 therein or therethrough that is configured to align with the aperture 340 of the base receiver 308 and that is also configured to receive the fastener and thereby limit inhibit rotation of the first portion 330 about the base connector axis 334. However, other manners of selectively inhibiting rotation of the base connector 324 about the base connector axis 334 are also envisioned and encompassed herein.

Figure 6A:
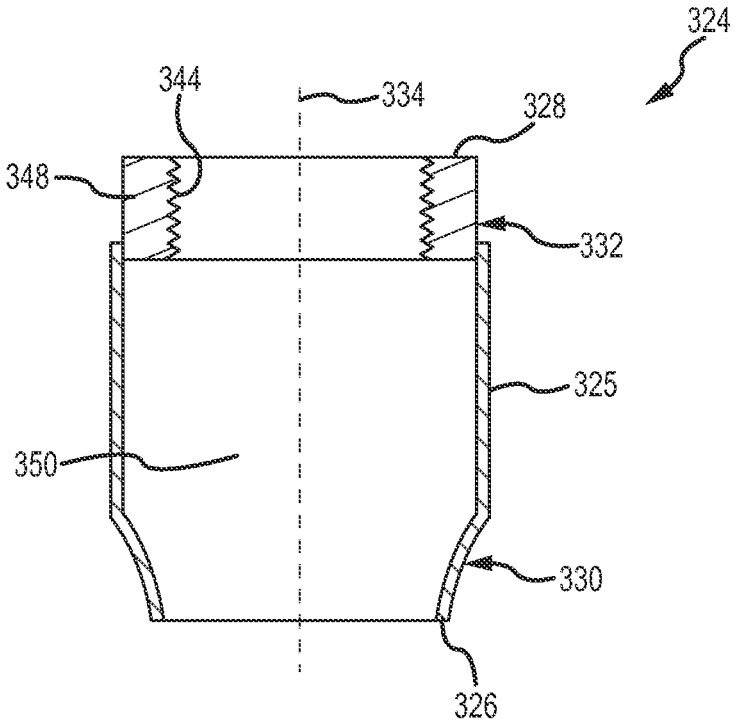
FIG. 6*a* is a cross-sectional view of a base connector of an adjustment apparatus of the support pedestal of FIG. 2, according to one embodiment.
Figure 6B:
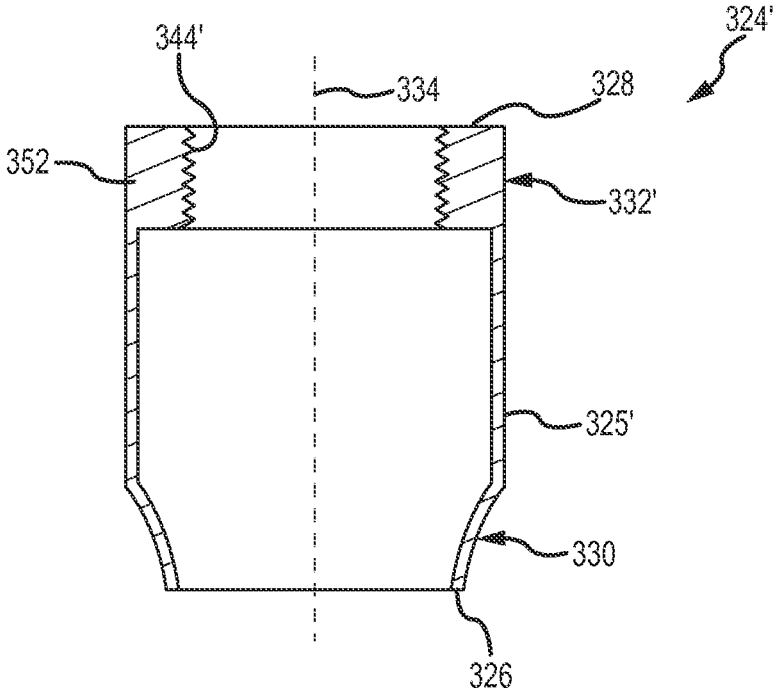
FIG. 6*b* is a cross-sectional view of a base connector of an adjustment apparatus of the support pedestal of FIG. 2, according to another embodiment.

The second portion 332 of the base connector 324 may include first or base connector threads 344 that are configured to threadably engage with corresponding threads on a threaded shaft 346 of the adjustment apparatus 302. In one arrangement, the second portion 332 may be in the form of a generally cylindrical member or wall having the base connector threads 344 on an inside surface thereof that are configured to threadably engage with corresponding threads on an exterior surface of the shaft 346. As an example, the second portion 332 may include an internally-threaded nut 348 rigidly or non-movably attached to a body 325 of the base connector 324 about the base connector axis 334 (e.g., via welding or the like). See FIGS. 2-5 and 6*a*. For instance, the body 325 may be in the form of a single, integral (e.g., one-piece) member having an opening or aperture 350 (labeled in FIG. 6*a*) extending therethrough along the base connector axis 334. Alternatively, the body 325 may be in the form of first and second members (e.g., a cylindrical member and a frustconical member) that are appropriately rigidly connected together and that collectively include an opening or aperture therethrough along the base connector axis 334. As another example, and with reference to the base connector 324' of FIG. 6*b*, the second portion 332' may include base connector threads 344' directly formed on an inside surface of the body 325' about the base connector axis 334 (e.g., such as on thickened portion 352 of the body 325).

Again with reference to FIGS. 2-5, the second connector of the adjustment apparatus 302 may be in the form of a second or support connector 354 having opposite first and second free ends 356, 358 respectively disposed on opposite first and second sections or portions 360, 362 of the support connector 354 and a second or support connector axis 364 extending through the first and second free ends 356, 358 and first and second portions 360, 362. For instance, the first portion 360 may be receivable in the opening (not shown) of the support receiver 318 in a direction along the support connector axis 364 and rotatable about the support connector axis 364 when received or disposed in the support receiver 318. That is, the first and second portions 360, 362 of the support connector 354 may be simultaneously rotatable about the support connector axis 364 when the first portion 360 is seated in the support receiver 318.

In one arrangement, the support connector 354 may be substantially identical to the base connector 324. For instance, the first portion 330 of the base connector 324 may be configured to be inserted into the base receiver 308 and the second portion 332 of the base connector 324 may be configured to threadably engage with corresponding threads on a first portion of the shaft 346 while the first portion 360 of the support connector 354 may be configured to be inserted into the support receiver 318 and the second portion 362 of the support connector 354 may include second or support connector threads that are configured to threadably engage with corresponding threads on an opposite second portion of the shaft 346, or vice versa. In the interest of brevity, further discussion regarding the structure of the support connector 354 will not be provided.

The shaft 346 is broadly configured to threadably engage with the base and support connectors 324, 354 to facilitate or otherwise effect adjustment between the base and support connectors 324, 354 and thus adjustment of the distance 322 between the base plate 306 and the support plate 316. More specifically, the shaft 346 broadly includes opposite first and second free ends 366, 368 respectively disposed on opposite first and second sections or portions 370, 372 of the shaft 346 and a shaft axis 374 extending through the first and second free ends 366, 368 and first and second portions 370, 372 (e.g., first and second segments, such as first and second halves). As shown, the first portion 370 includes first shaft threads 376 that are threadably engageable with the base connector threads 344 while the second portion 372 includes second shaft threads 378 that are threadably engageable with the support connector threads (not shown). Furthermore, the shaft axis 374, base connector axis 334 and support connector axis 364 are all collinear to a central axis 380 that runs through the center of the support pedestal 300 when the base and support connectors 324, 354 are respectively seated in the base and support receivers 308, 318 and the first and second threads 376, 378 of the shaft 346 are threadably engaged with the base connector threads 344 and the support connector threads (not shown). In one arrangement, the first and second threads 376, 378 of the shaft 346 may collectively extend along a substantial entirety of a length of the shaft 346 between the first and second free ends 366, 368.

In one arrangement, the first and second threads 376, 378 of the shaft 346 may respectively wind in opposite or reverse directions over the outer surface of the shaft 346 along the shaft axis 374. For instance, the first threads 376 may wind in a counterclockwise direction about the outer surface of the shaft 346 (e.g., where the base connectors threads 344 are configured to threadably engage with the counterclockwise threads) while the second threads may wind in a clockwise direction about the outer surface of the shaft 346 (e.g., where the support connectors threads are configured to threadably engage with the clockwise threads), or vice versa. See FIGS. 2-4. This arrangement allows, as will be discussed below, a user to rotate the shaft 346 about the shaft axis 374 and effect movement of the base and support connectors 308, 318 and thus the base and support members 304, 314 toward or away from each other in first and second directions along the central axis 380. In another arrangement, the first and second threads 376, 378 may wind in the same direction along the length of the shaft 346 (e.g., in the same clockwise or counterclockwise direction). For instance, the first and second threads 376, 378 may be part of a single continuous thread along the length of the shaft 346. Furthermore, the first and second portions 370, 372 (e.g., and first and second threads 376, 378) may or may not be separated by a gap or the like of any appropriate size.

To facilitate the reader's understanding of the various functionalities of the adjustment apparatus 302 of the support pedestal 300, various methods of use of the support pedestal 300 will now be discussed. With initial reference to FIGS. 2, 3, and 6*a*, a user may insert the first portions 330, 360 of the base and support connectors 324, 354 into the base and support receivers 308, 318, respectively. The user may also appropriately insert the first and second free ends 366, 368 of the shaft 346 into the second portions 332, 362 of the base and support connectors 324, 354 so that the first and second threads 376, 378 of the shaft 346 respectively threadably engage with the base connector threads 344 and the support connectors threads (not labeled) of the base and support connectors 324, 354. See FIGS. 4 and 5. At this point, the base plate 306 may or may not be disposed in a particular location on a fixed surface as part of a support structure (e.g., support structure 200 of FIG. 1) of an elevated building surface assembly (elevated building surface assembly 100 of FIG. 1) and the support plate 316 may or may not be loaded with one or building surface components (e.g., building surface components 102 of FIG. 1).

In any case, the adjustment apparatus 302 may now be manipulated by an operator in various manners to appropriately adjust a separation between the base and support plates 306, 316 (e.g., adjust the distance 322) for purposes of achieving a level or flush building surface (e.g., building surface 101 of FIG. 1), such as to account for differences in elevation of the underlying fixed surface. As one example, rotation of the base connector 324 about the base connector axis 334 in one of a clockwise or counterclockwise direction serves to increase or decrease the distance 322 between the base and support plates 306, 316 when the shaft 346 is held against rotation about the shaft axis 374 by moving the second free end 368 of the shaft 346 (and thus the support connector 354 and support member 314) away from or towards the base member 304 along the central axis 380, and vice versa.

For instance, assume the first portion 330 of the base connector 324 is rotatable about the base connector axis 334 within the base receiver 308 (e.g., where the fastener 341 would be removed from the base receiver 308 and first portion 330). Furthermore, assume the support connector 318 is selectively fixed against rotation about the support connector axis 364 (e.g., via insertion of fastener through support receiver 318 and into contact with or through aperture in first portion 360 of support connector 354) and that the support plate 316 is loaded with one or more building surface components or is otherwise held against rotation about the central axis 380 (e.g., such as via an operator holding the support plate 316). In this regard, grasping the shaft 346 to hold the shaft 346 against rotation while simultaneously grasping the base connector 324 (e.g., such as at a location between the first and second portions 330, 332) and rotating the same about the base connector axis 334 causes the base connector threads 344 to threadingly engage the first threads 376 of the shaft 346 and linearly move the shaft 346 (and thus the support connector 354 and support member 314) in one of a first or second opposite direction along the central axis 380 relative to the base connector 324 and base member 304 to effect an adjustment of the distance 322 (e.g., an increase or decrease) between the base and support plates 306, 316.

As another example, rotation of the support connector 354 about the support connector axis 364 in one of a clockwise or counterclockwise direction serves to increase or decrease the distance 322 between the base and support plates 306, 316 when the shaft 346 is held against rotation about the shaft axis 374 by moving the first free end 366 of the shaft 346 (and thus the base connector 324 and base member 304) away from or towards the support member 314 along the central axis 380. For instance, assume the first portion 360 of the support connector 354 is rotatable about the support connector axis 364 within the support receiver 318 (e.g., where the fastener, not labeled in FIGS. 4-5) would be removed from the support receiver 318 and first portion 360). Also assume the base connector 324 is selectively fixed against rotation about the base connector axis 334 (e.g., via insertion of the fastener 341 through the aperture 340 in the support receiver 318 and into contact with the first portion 330 of base connector 324 or through the aperture 342 in the first portion 330) and that the base plate 306 is held against rotation about the central axis 380 (e.g., such as via an operator holding the base plate 306).

In this regard, grasping the shaft 346 to hold the shaft 346 against rotation while simultaneously grasping the support connector 354 (e.g., such as at a location between the first and second portions 360, 362) and rotating the same about the support connector axis 364 causes the support connector threads (not labeled) to threadingly engage the second threads 378 of the shaft 346 and linearly move the shaft 346 in one of a first or second opposite direction along the central axis 380 relative to the support connector 354 and support member 314 to effect an adjustment of the distance 322 (e.g., an increase or decrease) between the base and support plates 306, 316. In the event the support plate 316 is loaded by one or more building surface components to frictionally engage the base plate 306 with the fixed surface, rotation of the support connector 354 results in the support connector threads either threading upwardly or downwardly along the second threads 378 of the shaft 346 to correspondingly linearly move the support member 314 towards or away from the base member 304 along the central axis 380.

As a further example, rotation of the shaft 346 about the shaft axis 374 in one of a clockwise or counterclockwise direction serves to increase or decrease the distance 322 between the base and support plates 306, 316 when the base and support connectors 324, 354 are respectively held against rotation about the base connector and support connector axes 334, 364 by moving the base and support connectors 324, 354 (and thus the base and support members 304, 314) away from or towards each other along the shaft 346 and the central axis 380 (e.g., such as when the first and second threads 376, 378 extend in opposite directions about the shaft 346). For instance, assume the base and support connectors 324, 354 are respectively selectively fixed against rotation about the base and support connector axes 334, 364 (e.g., via insertion of fasteners through the apertures in the base and support receivers 308, 318 and into contact with or through apertures in the first portions 330, 360 of the base and support connectors 324, 354). Also assume the base and support plates 306, 316 are respectively held against rotation against the central axis 380 such as by an operator holding the base and support members 304, 314 against such rotation.

In this regard, rotation of the shaft 346 about the shaft axis 374 respectively linearly pushes the base and support connectors 324, 354 (and thus the base and support members 304, 314) away from each other or pulls the base and support connectors 324, 354 (and thus the base and support members 304, 314) towards each other along the central axis 380 (and effects a corresponding adjustment of the distance 322). In the event the support plate 316 is loaded with one or more building surface components (e.g., is under at least minor compression) while the base plate 306 is frictionally disposed against a fixed surface, rotation of the shaft 346 about the shaft axis 374 in a first rotational direction allows the first threads 376 of the shaft 346 to "push off" against the base connector 324 along the central axis 380 to move the second free end 368 of the shaft 346 (and the support connector 354 and support member 314) away from the base member 304 while the second threads 378 push the support connector 354 (and the support member 304) along the central axis 380 away from the first free end 366 of the shaft 346, the base connector 324, and the base member 304. In contrast, rotation of the shaft 346 about the shaft axis 374 in an opposite second rotational direction allows the first threads 376 of the shaft 346 to "pull" against the base connector 324 along the central axis 380 to move the second free end 368 of the shaft 346 (and the support connector 354 and support member 314) towards the base member 304 while at the same time the second threads 378 pull the support connector 354 (and the support member 304) along the central axis 380 towards from the first free end 366 of the shaft 346, the base connector 324, and the base member 304. The resulting effect is an adjustment of the distance 322 between the base and support plates 306, 316 faster than operation of either of the base or support connectors 324, 354 alone.

As discussed previously, one or both of the base and support connectors 324, 354 may be tiltable relative to the base and support receivers 308, 318 to facilitate appropriate leveling of the support plate 316 and thus building surface components disposed thereon relative to the elevated building surface. For instance, assume the adjustment apparatus 302 has been used as discussed in one or more of the above manners to effect a substantially appropriate adjustment of the distance 322 between the base and support plates 306, 316. Also assume that the support plate 316 (e.g., a plane within which the support plate 316 lies) is not level or flush relative to support plates 316 of adjacent support pedestals 300. In this regard, an operator may appropriately manipulate the shaft 346 and/or support member 314 to tilt or pivot the shaft 346 relative to the base receiver 308 and/or the support member 314 relative to the support connector 354 to achieve appropriate leveling of the support plate 316. In the event a fastener 341 is disposed through the base receiver 308 and/or support receiver 318, the operator may first loosen and/or remove the fasteners 341 from the base receiver 308 and/or support receiver 318 and then re-fasten/ tighten the fasteners 341 to inhibit movement of the base and support connectors 324, 354 relative to the base and support receivers 308, 318.

In one arrangement, the support pedestal 300 may include one or more features configured to limit removal of the first and second free ends 366, 368 of the shaft 346 from the base and support connectors 324, 354. As just one example, the base connector 324 may include one or more apertures 382 therethrough through which an operator may insert a welding gun or the like to destroy or otherwise interrupt a portion of the first threads 376 to subsequently limit passage of such portion past the base connector threads 344 and thus removal of the first free end 366 from the base connector 324. In this regard, it is noted how the base connector threads 344 (e.g., on an inside surface of the second portion 332 of FIG. 5, not shown) may not extend along an entirety of the base connector 324 between the second and first free ends 328, 326 to thereby create a space 384 between the body 325 of the base connector 324 and the first threads 376 of the shaft 346. See FIG. 5.

That is, a portion of the first threads 376 of the shaft 346 near the first free end 366 of the shaft 346 may be in non-contact with the base connector threads 344 so that a welding gun or the like may be used to interrupt the portion of the first threads 376 for limiting removal of the first free end 366 from the base connector 324. For instance, the base connector threads may not extend along more than about 75% of a distance between the second and first free ends 328, 326, such as not along more than about 50% of a distance between the second and first free ends 328, 326. While not shown, the support connector 354 may also include one or more threads for corresponding manipulation of a portion of the second threads 378 of the shaft to limit removal of the second free end 368 from the support connector 354. Other manners of limiting removal of the first and second free ends 366, 368 of the shaft 346 from the base and support connectors 324, 354 are also envisioned and encompassed herein. In one arrangement, an operator may strike a portion of the threads of the shaft 346 with a hammer or other tool to interrupt the threads.

Figure 7:
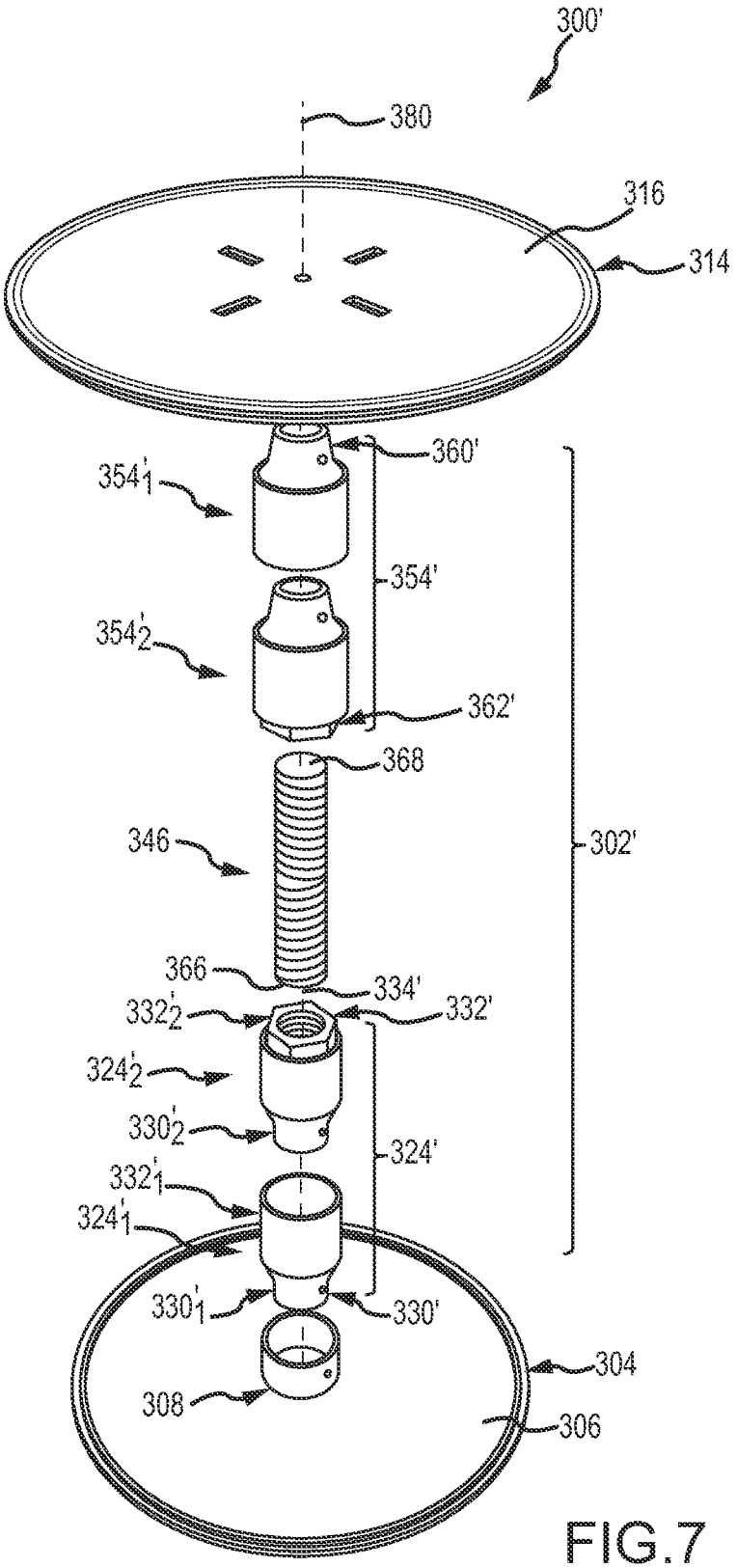
FIG. 7 is an exploded perspective view of a support pedestal for use with the assembly of FIG. 1, according to another embodiment.

FIG. 7 illustrates an exploded perspective view of a support pedestal 300' for use with the assembly of FIG. 1, according to another embodiment. As shown, the base connector 324' includes a plurality of base connector members, such as first and second base connector members $\mathbf{324_1}$', $\mathbf{324_2}$', where the first portion $\mathbf{330_2}$' of the second base connector member $\mathbf{324_2}$' is receivable in the second portion $\mathbf{332_1}$' of the first base connector member $\mathbf{324_1}$' and selectively non-rotatably securable thereto (e.g., via insertion of a fastener through aligned apertures in the second portion $\mathbf{332_1}$' of the first base connector member $\mathbf{324_1}$' and the first portion $\mathbf{330_2}$' of the second base connector member $\mathbf{324_2}$'). Each of the first and second base connector members $\mathbf{324_1}$', $\mathbf{324_2}$' includes an axis that is collinear with the base connector axis 334' as well as the central axis 380. The first portion $\mathbf{330_1}$' of the first base connector member $\mathbf{324_1}$' serves as the first portion 330' of the base connector 324' (and is thus receivable in the base receiver 308) while the second portion $\mathbf{332_2}$' of the second base connector member $\mathbf{324_2}$' serves as the second portion 332' of the base connector 324' (and thus includes base connector threads that are configured to threadably engage with the first threads 376 of the shaft 346).

When the first and second base connector members $\mathbf{324_1}$', $\mathbf{324_2}$' are interconnected, an internal passageway may be defined therethrough from the second portion $\mathbf{332_2}$' of the second base connector member $\mathbf{324_2}$' to the first portion $\mathbf{330_1}$' of the first base connector member $\mathbf{324_1}$' into or through which the shaft 346 may extend. For instance, the first base connector $\mathbf{324_1}$' may be free of base connector threads to allow the shaft 346 to pass freely therein or therethrough. Additionally or alternatively, the support connector 354 may include a plurality of support connector members such as first and second support connector members $\mathbf{354_1}$', $\mathbf{354_2}$'. In any case, this arrangement advantageously allows an operator to increase the distance 322 between the base and support plates 306, 316 while also increasing the range of attainable distances 322 through manipulation of the adjustment apparatus 302. While one or both of the base and support connectors 324', 354' are illustrated as having two connector members, one or both of the base and support connectors 324', 354' may include more than two connector members.

Figure 8:
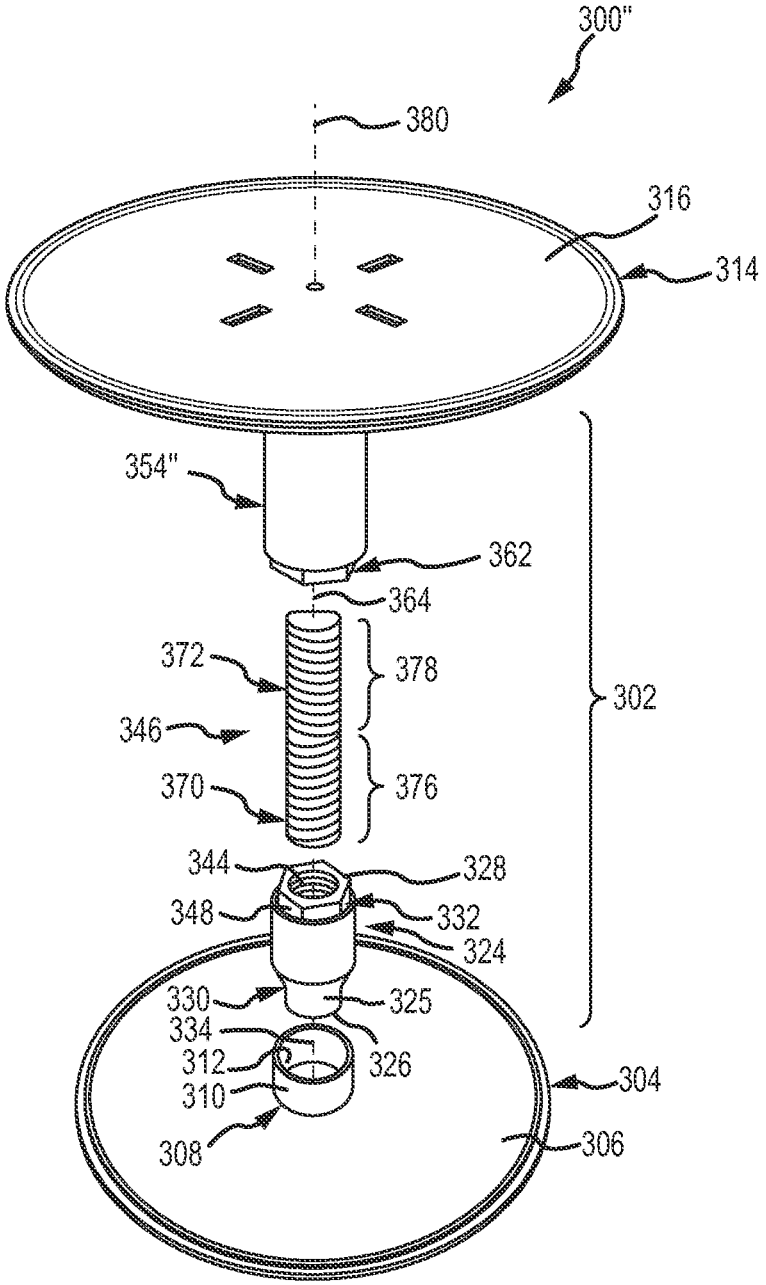
FIG. 8 is an exploded perspective view of a support pedestal for use with the assembly of FIG. 1, according to another embodiment.

In one variation, the second connector of the adjustment apparatus 302 may be rigidly attached to and thus non-movable relative to the base plate 306 or support plate 316. See FIG. 8. For instance, the support connector 354 may be rigidly attached to the support plate 314 in any appropriate manner such that rotation of the support connector 354 about the support connector axis 364 would entail simultaneous rotation of the support plate 316 about the support connector axis 364 (and thus the central axis 380). As an example, and turning to the embodiment of the support pedestal 300" of FIG. 8, the support receiver 320 may not be provided and the first free end (not shown) of the support connector 354" may be rigidly attached to the bottom surface of the support plate 316. As another example, the support member 314 may include the support receiver 318 attached to the support plate 316 as shown in the figures where the second free end 368 of the shaft 346 is directly threadably received into the opening of the support receiver 318. That is, the support connector 354 would not be provided and the support receiver would serve as the second connector. For instance, the threaded nut 360 may be rigidly secured to the wall 320 of the support receiver 318 about the central axis 380 so as to threadably receive the second threads 378 of the shaft 346. Alternatively, the interior of the wall 320 of the support receiver 318 may be appropriately threaded to engage with the second threads 378.

In one arrangement, the base and support plates 306, 316 may include one or more strengthening features disposed thereon or therein in any appropriate manner that are configured to resist bending or flexure of the base and support plates 306, 316. As an example, the base and support plates 306, 316 may respectively include ribs 386, 388 generally disposed along or near an outer periphery of the base and support plates 306, 316. See FIGS. 2-5. For instance, the ribs 386, 388 may be appropriately stamped into the base and support plates 306, 316 either during or after manufacture of the base and support plates 306, 316. While the base and support plates 306, 316 are each illustrated as including only a single rib 386, 388, the base and support plates 306, 316 may in some variations have one or more additional (e.g., concentric) ribs, such as a second rib about halfway between the illustrated rib and the center of the base and support plate 306, 316. As shown in FIGS. 2-5, the rib 386 of the base plate 306 may be configured to protrude from and extend away from an upper surface 390 thereof in a direction towards the support plate 314 to limit the degree to which any sharp edges of the rib 386 may puncture or otherwise damage portions of the fixed surface upon which the base member 304 is placed. In another arrangement, one or more rib(s) 386 of the base plate may additionally or alternatively protrude from a lower surface of the base plate 306.

Figure 9:
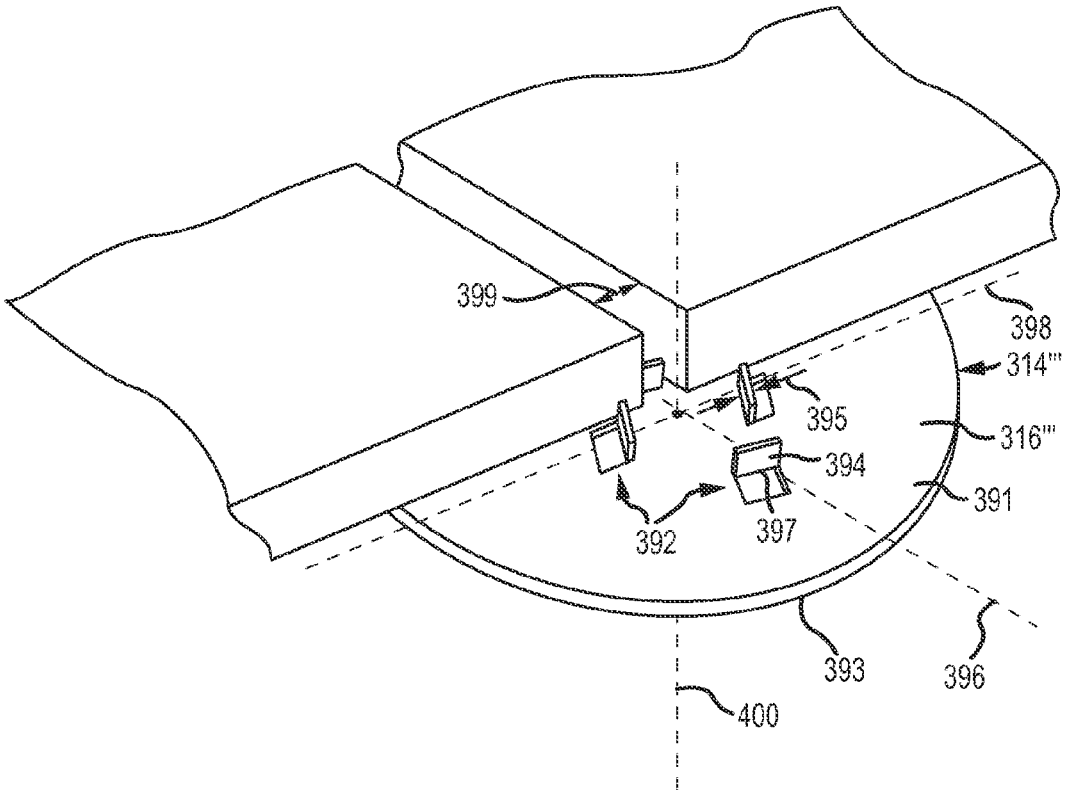
FIG. 9 is a perspective view of a support plate of a support pedestal for use with the assembly of FIG. 1, according to another embodiment.

FIG. 9 presents another embodiment of the support plate 316''' of the support member 314'''. In this embodiment, the support plate 316''' includes a plurality or series of spacing components 392 in the form of spacer tabs 394 protruding and extending away from a first (e.g., upper) surface of first and second opposite surfaces 391, 393 of the support plate 316''' upon which surface components 102 are configured to rest. Each spacer tab 394 is configured to space adjacent surface components 102 by any appropriate predetermined distance. For instance, each spacing component 392 may be formed by punching a punch through the support plate 316''' to fold respective portions of the support plate 316''' to form the respective spacer tabs 394. Stated differently, each spacer tab 394 may be "punched out" from the support plate 316''' so as to fold a portion of the support plate 316''' along a base 397 of the spacer tab 394. As used herein, the phrase "punched out" (and variations thereof) does not meant that each spacer tab 394 is punched in a manner so as to fully separate the spacer tab 394 from the support plate 316'''. Rather, each spacer tab 394 is punched in a manner so that a base 397 of each spacer tab 394 remains integrally connected (e.g., as one-piece) with the support plate 316''' along the base 397.

In one arrangement, the spacer tabs 394 may be formed over perpendicular first and second reference axes 396, 398 along the upper surface of the support plate 316''' (e.g., that are each perpendicular to a central axis 400 through the support plate 316''', the central axis 400 being perpendicular to the first and second opposite surfaces 391, 393) to allow for four surface components 102 (only one shown in FIG. 9) to be disposed on the support plate 316''' and separated from each other. For instance, first and second of the spacer tabs 394 may be disposed over the first reference axis 396 on first and second opposite sides of the central axis 400 and third and fourth of the spacer tabs 394 may be disposed over the second reference axis 398 on third and fourth opposite sides of the central axis 400. Of course, spacer tabs 394 may be formed along additional or different axes through the upper surface of the support plate 316''' to allow for more or fewer surface components 102 to be disposed thereon As illustrated, each spacer tab 394 may be angled relative to the axes 396, 398 to define a particular spacing 399 between adjacent surface components 102 that is greater than a thickness 395 of the spacer tabs 394 themselves. That is, rather than punching the spacer tabs 394 so that a base 397 (e.g., an axis extending along the base 397) of each spacer tab 394 is generally collinear with a respective one of the axes 396, 398, each base 397 may be disposed at a non-zero angle to its respective axis 396, 398, such as at 30°, 45°, 60°, and/or the like. For instance, manufacturers may be able to punch the spacer tabs 394 at a particular angle to achieve a particular desired surface component spacing 399.

While not shown, the support plate 316''' may include one or more ribs 388 (e.g., from FIGS. 2-5). In one arrangement, spacer tabs 394 and ribs 388 may be formed on the support plate 316''' substantially simultaneously as part of a single manufacturing process. As an example, a number of punches and an appropriately shaped die may be able to substantially simultaneously punch the through support plate 316''' and stamp the support plate 316''' to create the spacer tabs 394 and ribs 388, respectively. For instance, the ribs 388 and spacer tabs 394 may both protrude away from the same surface of the support plate 316''' (e.g., from the upper surface). In one arrangement, the support plate 316''' may include two or more ribs, where a first rib is disposed near or adjacent an outer periphery of the support plate 316''' and a second rib is disposed between the central axis 400 and the spacer tabs 394 or between the spacer tabs 394 and the first rib.

The support pedestal 300/300' may be constructed of any appropriate materials and in any appropriate manner. In one arrangement, the various components of the support pedestal (e.g., the base and support members 304, 314 and the adjustment apparatus 302) may be constructed of any appropriate fire resistant and/or noncombustible materials(s) such as metals (e.g., steel), carbon fiber, other suitable materials, and/or the like. In one arrangement, the various components of the support pedestal may be "noncombustible" as defined in ASTM International Designation E136-12.

The foregoing description has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. For instance, while the base connector threads 344 and support connector threads are shown and/or discussed as respectively beginning at the second free ends 328, 358 of the base and support connectors 324, 354, other arrangements envision that the base connector threads 344 and support connector threads begin inside of the second free ends 328, 358 (e.g., are recessed or inset relative to the second free ends 328, 358). As another example, the base and support connector threads may in some arrangements be disposed on an outside portion of the second portions 332, 362 of the base and support connectors 324, 354, respectively. In this arrangement, the shaft 346 would be in the form of an internally threaded shaft having first and second threads on the inside thereof respectively configured to engage with the externally threaded base and support connectors 324, 354.

As another example, the first portions 330, 360 of the base and support connectors 324, 354 may be configured to respectively receive and be selectively rotatable about base and support shafts extending away from the base and support plates 306, 316. For instance, the base and support receivers 308, 318 may be replaced by base and support shafts that are configured to be inserted into or received by the first portions 330, 360 of the base and support connectors 324, 354. The first portions 330, 360 may be generally cylindrical members having an inner diameter that is just greater than an outer diameter of the base and support shafts. To selectively inhibit rotation of the base and support connectors 324, 354 about the base and support shafts, fasteners or the like may be inserted through aligned apertures therethrough. In one arrangement, the body of each of the base and support connectors may have a generally constant outer diameter between the first and second free ends.

As a further example, the base member 304 may be identical or substantially identical to the support member 314 and the base connector 324 may be identical or substantially identical to the support connector 354 to limit manufacturing costs and/or complexities. Still further, while the base and support plates 306, 316 are illustrated as being circular, the base and support plates 306, 316 may take various other shapes as well (e.g., square, hexagonal, etc.). Moreover, while the base and support plates 306, 316 are illustrated as including ribs 386, 388 and the support plate 316 is further illustrated as including four elongated apertures (not labeled) therein or therethrough, some embodiments envision that the base and support plates 306, 316 do not include ribs and/or such apertures.

In one arrangement, one or more of the connectors (e.g., first connector 324, second connector 354) may include an additional third portion between the first and second portions having a diameter between that of the first and second portions. For instance, the first connector 324 may have a third portion between the first and second portions 330, 332, where a first swaged portion of the first connector 324 connects the first and third portions and a second swaged portion connects the third and second portions. Among other advantages, this arrangement allows for the degree of tilting of the first portion 330 in the base receiver 308 to be limited to a particular range.

It is also to be understood that the various components disclosed herein have not necessarily been drawn to scale. Also, many components have been labeled herein as "first," "second," "third," etc. merely to assist the reader in understanding the relationships between the components and does not imply that an elevated building surface assembly encompassed herein need necessarily have the specific arrangements shown and described herein.

One or more various combinations of the above discussed arrangements and embodiments are also envisioned. While this disclosure contains many specifics, these should not be construed as limitations on the scope of the disclosure or of what may be claimed, but rather as descriptions of features specific to particular embodiments of the disclosure. Furthermore, certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A support pedestal for adjustably supporting a building surface component above a fixed surface, comprising:

a base member including a base plate that is configured to be placed upon a surface;

a support member including a support plate that is configured to support at least one building surface component; and an adjustment apparatus interconnecting the base member and the support member that facilitates adjustment of each of the base member and support member relative to the other of the base member and the support member, wherein the adjustment apparatus includes:

a first connector having opposite first and second portions and a first connector axis extending through the first and second portions, wherein the first portion is receivable in a first receiver attached to and extending away from one of the base plate or support plate and rotatable about the first connector axis when the first portion is received in the first receiver, and wherein the second portion includes first connector threads;

a second connector having opposite first and second portions and a second connector axis extending through the first and second portions, wherein the first portion is attachable to the other of the base plate or support plate, and wherein the second portion includes second connector threads; and a shaft having opposite first and second portions and a shaft axis extending through the first and second portions, wherein the first portion includes first shaft threads that threadably engage with the first connector threads, wherein the second portion includes second shaft threads that threadably engage with the second connector threads; and wherein the first connector axis, the second connector axis and the shaft axis are collinear to a central axis;

wherein rotation of the first connector about the first connector axis adjusts a distance between the base plate and the support plate along the central axis, and wherein rotation of the shaft about the shaft axis adjusts a distance between the base plate and the support plate along the central axis.

2. The support pedestal of claim 1, wherein the second portion of the first connector includes inner and outer walls, wherein the first connector threads are disposed on the inner wall, wherein the first shaft threads are disposed on an outer wall on the first portion of the shaft, and wherein the first portion of the shaft is threadably receivable through the second portion of the first connector when the first portion of the first connector is received in the first receiver.

3. A support pedestal for adjustably supporting a building surface component above a fixed surface, comprising:

a base member including a base plate that is configured to be placed upon a surface;

a support member including a support plate that is configured to support at least one building surface component; and an adjustment apparatus interconnecting the base member and the support member that facilitates adjustment of each of the base member and support member relative to the other of the base member and the support member, wherein the adjustment apparatus includes:

a first connector having opposite first and second portions and a first connector axis extending through the first and second portions, wherein the first portion is receivable in a first receiver attached to and extending away from one of the base plate or support plate and rotatable about the first connector axis when the first portion is received in the first receiver, and wherein the second portion includes first connector threads;

a second connector having opposite first and second portions and a second connector axis extending through the first and second portions, wherein the first portion is attachable to the other of the base plate or support plate, and wherein the second portion includes second connector threads; and a shaft having opposite first and second portions and a shaft axis extending through the first and second portions, wherein the first portion includes first shaft threads that threadably engage with the first connector threads, wherein the second portion includes second shaft threads that threadably engage with the second connector threads; and wherein the first connector axis, the second connector axis and the shaft axis are collinear to a central axis;

wherein rotation of the first connector about the first connector axis adjusts a distance between the base plate and the support plate along the central axis, and wherein rotation of the shaft about the shaft axis adjusts a distance between the base plate and the support plate along the central axis wherein the first connector further includes a nut fixedly attached to the second portion thereof, wherein the nut includes nut threads, and wherein the nut threads are the first connector threads.

4. The support pedestal of claim 1, wherein the first connector includes a first free end on the first portion thereof and a second free end on the second portion thereof, and wherein the first connector threads do not extend from the second free end to the first free end.

5. The support pedestal of claim 4, wherein an outer diameter of the first portion of the first connector decreases in a direction towards the first free end to facilitate tilting of the first connector relative to the first receiver.

6. The support pedestal of claim 5, wherein the first portion includes a frustoconical shape.

7. The support pedestal of claim 1, wherein the first connector includes a plurality of first connector members, wherein each first connector member includes opposite first and second portions and a first connector member axis extending through the first and second portions, wherein the plurality of first connector member axes are collinear with the first connector axis, and wherein the first portion of one of the first connector members is receivable in the second portion of an adjacent one of the first connector members.

8. The support pedestal of claim 1, wherein the first receiver includes an aperture through a portion thereof that is configured to receive a fastener therethrough to selectively inhibit rotation of the first connector about the first connector axis when the first portion of the first connector is received in the first receiver.

9. The support pedestal of claim 1, wherein the first receiver is attached to the base plate.

10. The support pedestal of claim 9, wherein the first portion of the second connector is rigidly attached to the support plate, and wherein the second connector is non-rotatable relative to the support plate.

11. The support pedestal of claim 1, wherein the first receiver is attached to the support plate.

12. The support pedestal of claim 11, wherein the first portion of the second connector is rigidly attached to the base plate, and wherein the second connector is non-rotatable relative to the base plate.

13. The support pedestal of claim 1, wherein the first portion of the second connector is receivable in a second receiver attached to and extending away from the other of the base plate or support plate and rotatable about the second connector axis when the first portion is received in the second receiver, and wherein rotation of the second connector about the second connector axis adjusts a distance between the base plate and the support plate along the central axis.

14. The support pedestal of claim 13, wherein the second portion of the second connector includes inner and outer walls, wherein the second connector threads are disposed on the inner wall, wherein the second shaft threads are disposed on an outer wall on the second portion of the shaft, and wherein the second portion of the shaft is threadably receivable through the second portion of the second connector when the first portion of the second connector is received in the second receiver.

15. The support pedestal of claim 13, wherein the second connector further includes a nut fixedly attached to the second portion thereof, wherein the nut includes nut threads, and wherein the nut threads are the second connector threads.

16. The support pedestal of claim 13, wherein the second connector includes a first free end on the first portion thereof and a second free end on the second portion thereof, and wherein the second connector threads do not extend from the second free end to the first free end.

17. The support pedestal of claim 16, wherein an outer diameter of the first portion of the second connector decreases in a direction towards the first free end to facilitate tilting of the second connector relative to the second receiver.

18. The support pedestal of claim 17, wherein the first portion includes a frustoconical shape.

19. The support pedestal of claim 13, wherein the second connector includes a plurality of second connector members, wherein each second connector member includes opposite first and second portions and a second connector member axis extending through the first and second portions, wherein the plurality of second connector member axes are collinear with the second connector axis, and wherein the first portion of one of the second connector members is receivable in the second portion of an adjacent one of the second connector members.

20. The support pedestal of claim 13, wherein the second receiver includes an aperture through a portion thereof that is configured to receive a fastener therethrough to selectively inhibit rotation of the second connector about the second connector axis when the first portion of the second connector is received in the second receiver.

21. The support pedestal of claim 1, wherein the shaft includes a first free end on the first portion thereof and a second free end on the second portion thereof, and wherein the first and second shaft threads collectively extend along a substantial entirety of the shaft between the first and second free ends.

22. The support pedestal of claim 1, wherein the first shaft threads extend in one of a clockwise or counterclockwise direction, and wherein the second shaft threads extend in the other of the clockwise or counterclockwise direction.

23. The support pedestal of claim 1, wherein a portion of at least one of the first or second shaft threads is interrupted to limit respective disengagement from the first or second connector threads.

24. A method, comprising:

providing the support pedestal of claim 1;

inhibiting rotation of the shaft about the shaft axis; and rotating, during the inhibiting, the first connector about the first connector axis to thread the first connector threads along the first shaft threads and adjust the distance between the support plate and the base plate along the central axis.

25. The method of claim 24, wherein the inhibiting includes:

inhibiting rotation of the second connector and the other of the base plate or support plate about the first connector axis.

26. A method, comprising:

providing a support pedestal for adjustably supporting a building surface component above a fixed surface, the support pedestal comprising:

a base member including a base plate that is configured to be placed upon a surface;

a support member including a support plate that is configured to support at least one building surface component; and an adjustment apparatus interconnecting the base member and the support member that facilitates adjustment of each of the base member and support member relative to the other of the base member and the support member, wherein the adjustment apparatus includes:

a first connector having opposite first and second portions and a first connector axis extending through the first and second portions, wherein the first portion is receivable in a first receiver attached to and extending away from one of the base plate or support plate and rotatable about the first connector axis when the first portion is received in the first receiver, and wherein the second portion includes first connector threads;

a second connector having opposite first and second portions and a second connector axis extending through the first and second portions, wherein the first portion is attachable to the other of the base plate or support plate, and wherein the second portion includes second connector threads; and a shaft having opposite first and second portions and a shaft axis extending through the first and second portions, wherein the first portion includes first shaft threads that threadably engage with the first connector threads, wherein the second portion includes second shaft threads that threadably engage with the second connector threads; and wherein the first connector axis, the second connector axis and the shaft axis are collinear to a central axis;

wherein rotation of the first connector about the first connector axis adjusts a distance between the base plate and the support plate along the central axis, and wherein rotation of the shaft about the shaft axis adjusts a distance between the base plate and the support plate along the central axis;

first inhibiting rotation of the second connector and the other of the base plate or support plate about the second connector axis;

second inhibiting rotation of the first connector and the one of the base plate or support plate about the first connector axis; and rotating, during the first and second inhibiting, the shaft about the shaft axis to simultaneously respectively thread the first and second shaft threads along the first and second connector threads and adjust the distance between the support plate and the base plate along the central axis.

27. An elevated building surface assembly, comprising:

a plurality of the support pedestals of claim 1 disposed in spaced-apart relation on a fixed surface; and a plurality of building surface components disposed on the support plates of the support pedestals to form an elevated flooring surface.

* * * * *